US008025024B2

(12) United States Patent
Halse

(10) Patent No.: US 8,025,024 B2
(45) Date of Patent: Sep. 27, 2011

(54) PIPE JOINT LUBRICATION DEVICE

(75) Inventor: Helge-Ruben Halse, Kristiansand S. (NO)

(73) Assignee: V-Tech AS, Kristiansand (NO)

( * ) Notice: Subject to any disclaimer, the term of this patent is extended or adjusted under 35 U.S.C. 154(b) by 734 days.

(21) Appl. No.: 11/720,537

(22) PCT Filed: Dec. 14, 2005

(86) PCT No.: PCT/NO2005/000461

§ 371 (c)(1),
(2), (4) Date: May 31, 2007

(87) PCT Pub. No.: WO2006/065149

PCT Pub. Date: Jun. 22, 2006

(65) Prior Publication Data

US 2008/0121174 A1 May 29, 2008

(30) Foreign Application Priority Data

Dec. 16, 2004 (NO) ..... 20045501

(51) Int. Cl.
*B08B 3/02* (2006.01)

(52) U.S. Cl. ..... 118/320; 118/DIG. 11; 118/313; 81/57.15

(58) Field of Classification Search ..... 239/741; 118/320, DIG. 11, 313; 81/57.15
See application file for complete search history.

(56) References Cited

U.S. PATENT DOCUMENTS

| | | | | |
|---|---|---|---|---|
| 2,923,192 | A * | 2/1960 | Montgomery et al. | 81/57.44 |
| 6,550,547 | B1 * | 4/2003 | Payne et al. | 175/24 |
| 6,589,343 | B1 * | 7/2003 | Egeland | 118/315 |
| 6,748,823 | B2 * | 6/2004 | Pietras | 81/57.34 |
| 7,000,503 | B2 * | 2/2006 | Dagenais et al. | 81/57.35 |
| 2004/0026080 | A1 | 2/2004 | Reinholdt et al. | |
| 2008/0223418 | A1 * | 9/2008 | Vatne | 134/99.1 |

FOREIGN PATENT DOCUMENTS

| | | |
|---|---|---|
| NO | 173893 | 6/1993 |
| WO | WO 99/60245 | 11/1999 |
| WO | WO 0149968 A1 * | 7/2001 |

OTHER PUBLICATIONS

Written Opinion, Feb. 14, 2006, PCT Office.

* cited by examiner

*Primary Examiner* — Dah-Wei Yuan
*Assistant Examiner* — Charles Capozzi
(74) *Attorney, Agent, or Firm* — Gable Gotwals

(57) ABSTRACT

A pipe joint lubrication device including at least one first nozzle for application of lubricant on at least one of the fittings, a threaded nipple or a threaded socket, wherein the at least one first nozzle is provided on a first jaw housing which is rotatable about the longitudinal axis of the nipple or the socket.

10 Claims, 1 Drawing Sheet

PIPE JOINT LUBRICATION DEVICE

CROSS REFERENCE TO PENDING APPLICATIONS

This application is based on PCT Patent Application No. NO2005/000461, filed on Dec. 14, 2005, which claims priority to Norwegian Patent Application No. 20045501 filed Dec. 16, 2004 which is incorporated herein by reference.

STATEMENT REGARDING FEDERALLY SPONSORED RESEARCH

Not applicable.

NAMES OF THE PARTIES TO A JOINT RESEARCH AGREEMENT

Not applicable.

REFERENCE TO A SEQUENCE LISTING

Not applicable.

BACKGROUND OF THE INVENTION

This invention regards a pipe joint lubrication device. More particularly, it regards a pipe joint lubrication device for lubrication of the threads of a pipe socket (socket) and of a pipe nipple (nipple). The lubricant is sprayed on while the nipple is rotated relative to the socket, the rotation taking place about the longitudinal axis of the socket and the nipple. The pipe joint lubrication device is particularly well suited for lubrication of the joints of a pipe string, such as is known from e.g. petroleum exploration and production.

It is customary when joining e.g. threaded drill pipes, to apply a lubricant (dope) on the threads, both in the socket and on the nipple. The purpose of the lubricant application is, in addition to facilitating the coupling and uncoupling of the pipes, to seal the threaded connection between the socket and the nipple when this is exposed to the relatively high fluid pressure encountered during drilling.

Previously it has been customary to apply the lubricant manually by means of e.g. a brush, However, mechanized lubricating apparatuses have been developed, in which the lubricant is sprayed onto the threads via nozzles, e.g. by use of compressed air.

Mechanized lubricating apparatuses according to prior art comprise relatively complicated positioning mechanisms and often represent an obstacle to efficient coupling of pipe lengths, as the lubricating apparatus must be brought up to the coupling location for each lubricating operation.

The object of the invention is to remedy or at least reduce at least one of the disadvantages of prior art.

The object is achieved in accordance with the invention, by the characteristics given in the description below and in the following claims.

BRIEF SUMMARY OF THE INVENTION

The invention is realized through a pipe joint lubrication device comprising at least one first nozzle for application of the lubricant on at least one of the fittings; a threaded nipple or a threaded socket, where the at least one first nozzle is arranged on a first (clamping) jaw housing which is rotatable about the longitudinal axis of the nipple or socket.

Preferably the at least one first nozzle is supplied with lubricant via a duct in a swivel ring that encircles the first jaw housing and is stationary relative to the first jaw housing.

Advantageously at least one second nozzle is provided on a second jaw housing which is stationary relative to the longitudinal axis of the nipple or the socket, the second nozzle being arranged to spray lubricant towards at least one of the fittings; the threaded nipple or the threaded socket, while the fitting rotates about its own longitudinal axis.

Most advantageously the first jaw housing forms part of the make-up tong of a power tong, while the second jaw housing forms part of the holding-up tong of the power tong.

Advantageously the power tong comprises a retractable spacing mandrel arranged to establish and maintain a desired distance between the make-up tong and the holding-up tong during the application of lubricant.

The pipe joint lubrication device of the invention is particularly suitable in connection with a so-called closed power tong, where the power tong remains centered about the pipe string, also when the power tong is not in use.

BRIEF DESCRIPTION OF THE DRAWINGS

The following describes a non-limiting example of a preferred embodiment illustrated in the accompanying drawing, in which.

DETAILED DESCRIPTION OF THE INVENTION

Figure 1:
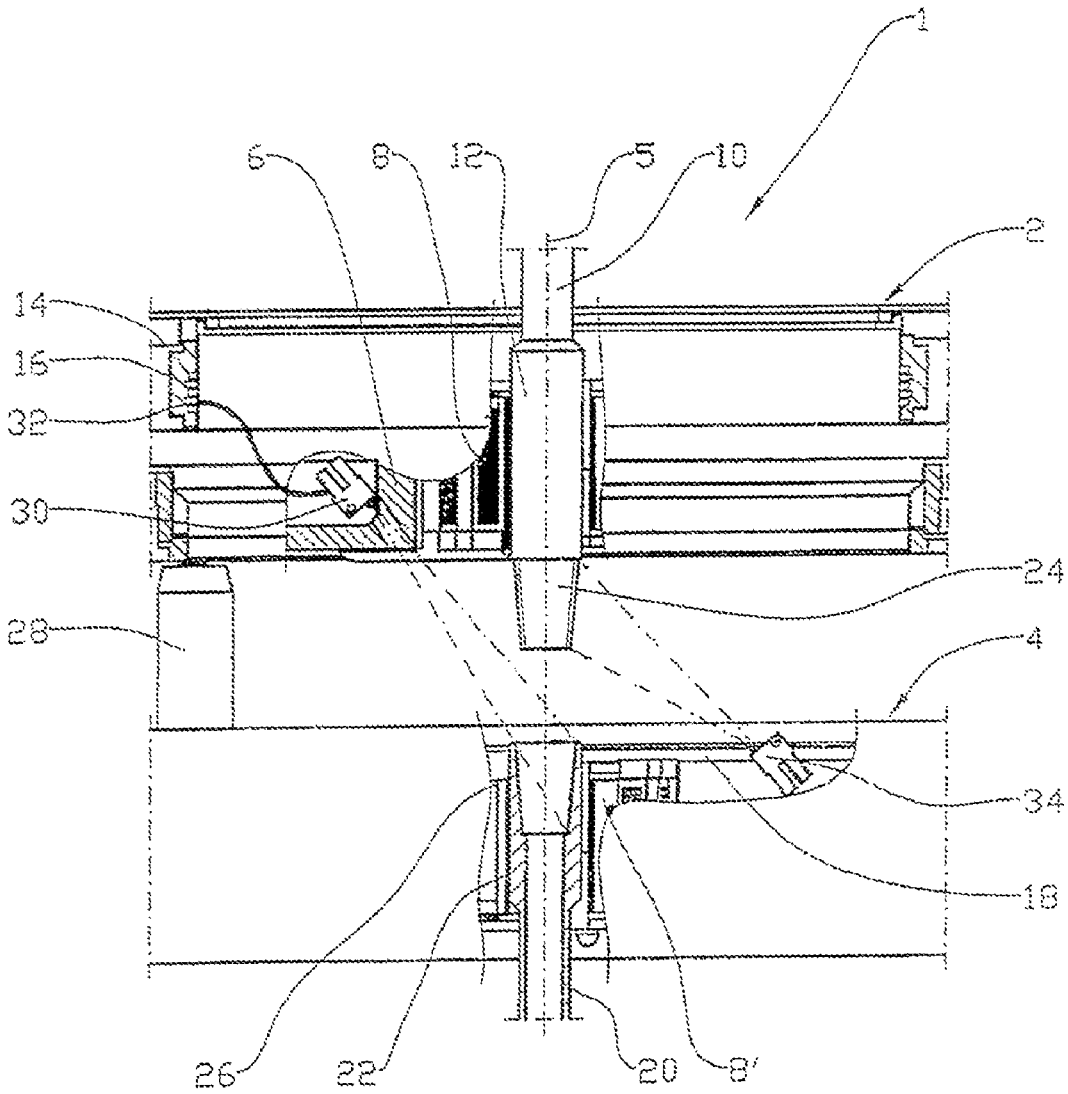
FIG. 1 shows a partially sectioned side view of the power tong as lubricant is being sprayed onto corresponding thread areas.

In the drawings, reference number 1 denotes a power tong comprising an upper make-up tong 2 and a lower holding-up tong 4. The make-up tong 2 and the holding-up tong 4 can be moved vertically by means of machine elements (not shown).

The make-up tong 2 is provided with a first jaw housing 6 which is rotatable about a vertical axis 5. The first jaw housing 6 comprises hydraulically operated clamping jaws 8 arranged to clamp around the lower end portion 12 of a pipe length 10.

The hydraulically operated clamping jaws 8 are supplied with pressurized fluid via ducts 14 in a swivel ring 16, the first jaw housing 6 being sealingly rotatable in the swivel ring 16. Other hydraulic connections required are not shown.

A second, rigidly mounted jaw housing 18 is located in the holding-up tong 4. Hydraulic clamping jaws 8' in the second jaw housing 18 are arranged to grip the upper end portion 22 of a pipe string 20. The central axes of the pipe length 10 and the pipe string 20 at the power tong 1 generally correspond with the vertical central axis 5 of the power tong 1.

It is customary for the lower end portion 12 of the pipe length 10 to be provided with a threaded nipple 24, and for the upper end portion 22 of the pipe string 20 to be provided with a threaded socket 26, as shown in the example of embodiment.

The holding-up tong 4 is provided with a retractable spacing mandrel 28 arranged to establish and maintain a specified vertical spacing between the make-up tong 2 and the holding-up tong 4.

A first nozzle 30 is provided in the first jaw housing 6 and is supplied with lubricant and compressed air via ducts 32 in the swivel ring 16. Thus, the nozzle 30 is designed to spray lubricant towards the threaded socket 26 while rotating about the axis 5.

A second nozzle 34 is provided in the second jaw housing 18 and is arranged to spray lubricant towards the threaded nipple 24. If the threaded nipple 24 is rotated about the axis 5, the lubricant is distributed around the nipple 24.

With the exception of ducts 32, feed pipes for lubricant and compressed air to the nozzles 30 and 34 are not shown.

When the upper socket of the pipe string 20 is fastened and stationary in the holding-up tong 4 while the nipple 24 on the pipe length 10 is fastened and rotates about the axis 5 in the make-up tong 2, and the socket 26 and the nipple 24 are at an appropriate level relative to the power tong 1, both the socket 26 and the nipple 24 may be lubricated simultaneously by nozzles 30 and 34.

The invention claimed is:

1. A pipe joint lubrication device for application of lubricant on a fitting having a longitudinal axis, said device comprising:

a first jaw housing forming part of a make-up tong of a power tong, the housing is rotatable about the longitudinal axis of the fitting wherein the first jaw housing is provided with an axial through opening which forms part of a make-up tong of a power tong, the first jaw housing including a swivel ring that encircles the first jaw housing and is stationary relative to the first jaw housing;

at least one first nozzle in said first jaw housing, the at least one first nozzle being supplied with lubricant via a duct in said swivel ring and located to spray lubricant towards the fitting located in a second jaw housing of the power tong while said at least one first nozzle rotates about the longitudinal axis; and a second nozzle placed on the second jaw housing which is stationary relative to the longitudinal axis of the fitting, the second nozzle being arranged to spray lubricant towards a second fitting located in said first jaw housing; while the fitting rotates about its own longitudinal axis; and wherein the fitting and second fitting can be simultaneously lubricated.

2. The pipe joint lubrication device according to claim 1, wherein the second jaw housing forms part of a holding-up tong of the power tong.

3. The pipe joint lubrication device according to claim 1, wherein the power tong comprises a retractable spacing mandrel arranged to establish and maintain a desired distance between the make-up tong and the holding-up tong during the application of lubricant.

4. The pipe joint lubrication device in accordance with claim 1, wherein the fitting is comprising a nipple.

5. The pipe joint lubrication device in accordance with claim 1, wherein the fitting is comprising a threaded socket.

6. A pipe joint lubrication device for application of lubricant on a fitting having a longitudinal axis, said device comprising:

at least one first nozzle in a first jaw housing which is rotatable about the longitudinal axis of the fitting and located to spray lubricant towards the fitting located in a second jaw housing while said at least one first nozzle rotates about the longitudinal axis;

wherein the first jaw housing is provided with an axial through opening which forms part of a make-up tong of a power tong, the first jaw housing includes a swivel ring that encircles the first jaw housing and is stationary relative to the first jaw housing; and having a retractable spacing mandrel arranged to establish and maintain a desired distance between the make-up tong and a holding-up tong during application of lubricant; and a second nozzle placed on the second jaw housing which is stationary relative to the longitudinal axis of the fitting, the second nozzle being arranged to spray lubricant towards a second fitting located in the first jaw housing; while the second fitting rotates about its own longitudinal axis; and wherein the fitting and second fitting can be simultaneously lubricated.

7. The pipe joint lubrication device in accordance with claim 6, further comprising the one at least one first nozzle being supplied with lubricant via a duct in the swivel ring that encircles the first jaw housing and is stationary relative to the first jaw housing.

8. The pipe joint lubrication device in accordance with claim 7, wherein the second jaw housing forms part of a holding-up tong of the power tong.

9. The pipe joint lubrication device in accordance with claim 6, wherein the fitting is comprising a nipple.

10. The pipe joint lubrication device in accordance with claim 6, wherein the fitting is comprising a threaded socket.

* * * * *